US006714211B2

(12) United States Patent
Yoshida et al.

(10) Patent No.: US 6,714,211 B2
(45) **Date of Patent: *Mar. 30, 2004**

(54) METHOD AND EQUIPMENT FOR MONITOR CALIBRATION AND STORAGE MEDIUM STORING A PROGRAM FOR EXECUTING THE METHOD

(75) Inventors: Yasunari Yoshida, Ama-gun (JP); Masaaki Hibino, Yotsukaichi (JP); Koji Kobayakawa, Ichinomiya (JP); Kiyotaka Ohara, Nagoya (JP); Masashi Ueda, Nagoya (JP); Masaaki Hori, Tajimi (JP)

(73) Assignee: Brother Kogyo Kabushiki Kaisha, Nagoya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/926,029

(22) Filed: Sep. 9, 1997

(65) Prior Publication Data

US 2002/0057282 A1 May 16, 2002

(30) Foreign Application Priority Data

Sep. 11, 1996 (JP) ..... 8-240591

(51) Int. Cl.[7] ..... G09G 5/10

(52) U.S. Cl. ..... 345/690; 348/180

(58) Field of Search ..... 348/180, 181, 348/182, 189, 190, 191, 379; 345/147, 690, 698, 214

(56) References Cited

U.S. PATENT DOCUMENTS

| | | | | |
|---|---|---|---|---|
| 5,298,993 A | | 3/1994 | Edgar et al. | 348/180 |
| 5,343,242 A | * | 8/1994 | Rowsell et al. | 348/189 |
| 5,872,592 A | * | 2/1999 | Manea et al. | 348/189 |
| 6,008,836 A | * | 12/1999 | Bruck et al. | 348/13 |

* cited by examiner

*Primary Examiner*—Dennis-Doon Chow
(74) *Attorney, Agent, or Firm*—Oliff & Berridge, PLC

(57) ABSTRACT

A monitor calibration method for determining the black point of a monitor display, wherein a solid black display area and a gray display area are displayed on a monitor screen in the form of stripes, for example, so that each display area is sandwiched by the other type of display area. Then, while the brightness of the gray display area is gradually changed, the user signals OK using a mouse device at the point in time that the viewer determines a difference between the two display areas. The input value of the gray display area at that time is fixed and saved as the black point. By arranging the display areas in alternating stripes, even a subtle difference in the two display areas is visually striking. Hence, a very accurate black point can be determined.

13 Claims, 10 Drawing Sheets

METHOD AND EQUIPMENT FOR MONITOR CALIBRATION AND STORAGE MEDIUM STORING A PROGRAM FOR EXECUTING THE METHOD

BACKGROUND OF THE INVENTION

1. Field of the Invention

The present invention relates to a monitor calibration method, monitor calibration equipment, and a storage medium storing a program for executing the monitor calibration method, all of which aid the viewer in detecting the black point of a monitor display.

2. Description of the Related Art

Generally, monitors such as CRT display-type monitors have a nonlinear display relationship between the RGB input value and the brightness, as shown in FIG. 1. Any input value below a certain input value BP has a brightness of zero and is therefore not visible to humans. This input value BP is referred to as the black point.

The black point can be changed by adjusting functions such as brightness on the monitor itself. The black point also fluctuates due to deterioration of the monitor caused by aging and to slight differences in human vision. By finding the black point in order to learn the relationship between the input values and the images displayed on the monitor, the same color tones as those displayed on the monitor can be reproduced by a color printer or other device based on the discovered relationship.

A black point detection method has been proposed in the art, wherein, as shown in FIG. 2, the solid black display area Bk with an RGB value of 0 and a gray display are Gy with a variable RGB input value greater than 0 are displayed side by side on a monitor. A maximum RGB input value at which the display areas Bk and the disply area Gy cannot be distinguished is searched for by increasing and decreasing the RGB input value for the gray display are Gy. The black point is set to this maximum RGB value.

However, determining the black point according to the method described above results in a wide range of measurements, indicating that the method is insufficiently precise.

SUMMARY OF THE INVENTION

In view of the foregoing, it is an object of the present invention to provide a monitor calibration method, monitor calibration equipment, and a storage medium storing a program for executing the monitor calibration method, all of which can aid the viewer in measuring the black point of a monitor display with great precision. The following is a description of the features and benefits of the present invention.

The monitor calibration method of the present invention aids a viewer in detecting the black point of a monitor by displaying a solid black display area and a gray display area adjacent to one another and gradually changing the brightness of the gray display area from light to dark or from dark to light, wherein at least one portion of the solid black display area is interposed in the gray display area and at least one portion of the gray display area is interposed in the solid black display area. Here the solid black display area is an area in which the pixels are displayed in solid black, that is, with an input value of 0. The gray display area is an area in which the pixels are displayed with an input value greater than or equal to 0. However, it is not necessary to include 0 in the possible range of input values for the gray display area.

In a monitor calibration method of the prior art, shown in FIG. 2, the gray display area Gy is sandwiched by the solid black display area Bk. However, the solid black display area Bk is not sandwiched by the gray display area Gy.

In the present invention, at least one portion of the solid black display area is interposed in the gray display area and at least one portion of the gray display area is interposed in the solid black display area. In other words, at least a portion of each area is sandwiched by the other area. The difference in brightness seen in the gray display area sandwiched by the solid black display area appears differently from the difference in brightness seen in the solid black display area sandwiched by the gray display area. By looking at both appearances simultaneously, even a subtle difference in brightness between the two display areas is visually striking. Hence, a very accurate black point can be determined.

One example for sandwiching at least one portion of each area by the other area is for the solid black display area and the gray display area to be stripe-shaped and arranged alternately. Further, if the alternately arranged stripes of the solid black display area and the gray display area have a width of between 1/72 and 1/4 inch, and in particular a width of between 1/36 and 1/8 inch, a very accurate black point can be determined.

The monitor calibration method of the present invention aids a viewer in detecting the black point of a monitor by displaying a solid black display area and a gray display area adjacent to one another and gradually changing the brightness of the gray display area from light to dark or from dark to light, wherein one portion of either the solid black display area or the gray display area is surrounded by the other display area.

In the prior art shown in FIG. 2, neither the gray display area Gy nor the solid black display area Bk is surrounded by the other display area. In the present invention, however, one portion of either the solid black display area or the gray display area is surrounded by the other display area. For this reason, a display area abuts another display area not only on the left and right (nor only up and down), but left and right, up and down, and diagonally. Hence, even a subtle difference between the two display areas is visually striking, and a very accurate black point can be determined.

Further, the display area that is surrounded by the other display area can be formed in a specific shape, such as the shape of a star, alphanumeric characters, or the like. It is desirable if the shape formed by this display area contains portions having a width of between 1/72 and 1/4 inch, and particularly contains portions having a width of between 1/36 and 1/8 inch. Accordingly, a very accurate black point can be determined. The more portions of the display area that have this size of width, the more accurate the black point determination will be.

In addition to the above-described monitor calibration method, it is possible to include a process in which the brightness of the solid black display area and the gray display area are periodically exchanged, while the brightness of the gray display area is gradually changed from light to dark or from dark to light.

Through this process, the borders between the solid black display area and the gray display area will always be emphasized so that even a subtle difference in brightness between the two display areas is visually striking. Hence, a very accurate black point can be determined.

Alternatively, it is possible to perform a process in which the gray display area is periodically displayed in solid black, while the brightness of the gray display area is gradually changed from light to dark or from dark to light. Hence, because the gray display area is switched back and forth between displaying solid black and displaying gray, while the brightness of the gray is gradually changing, the borders between the solid black display area and the gray display area will always be emphasized so that even a subtle difference in brightness between the two display areas is visually striking. Hence, a very accurate black point can be determined.

The monitor calibration method of the present invention aids a viewer in detecting the black point of a monitor by displaying a first gray display area and a second gray display area adjacent to one another and changing the brightnesses of the two display areas from light to dark while either maintaining the difference in the two brightnesses or decreasing the difference between the two brightnesses, or changing the brightnesses of the two display areas from dark to light while either maintaining the difference in the two brightnesses or increasing the difference between the two brightnesses.

Therefore, instead of a solid black display area, two gray display areas with different brightnesses are used, and a very accurate black point can be determined by changing the brightnesses of the two display areas from light to dark while either maintaining or decreasing the difference in the two brightnesses, or by changing the brightnesses of the two display areas from dark to light while either maintaining or increasing the difference in the two brightnesses.

Since the brightnesses for both a first gray display area and a second gray display area are changed in order to determine the black point, it is possible to acquire an appropriate and more precise black point input value for use in actual image displays by the dynamically changing brightness of the entire display.

In this case as well, it is desirable for at least one portion of the first gray display area to be interposed in the second gray display area and at least one portion of the second gray display area to be interposed in the first gray display area in order to determine a more accurate black point. Further, it is desirable for the first gray display area and the second gray display area to be stripe-shaped and arranged alternately. The alternately arranged stripes of the first gray display area and the second gray display area should have a width of between 1/72 and 1/4 inch, and particularly a width of between 1/36 and 1/8 inch in order to determine a more accurate black point.

Further, as described above, either the first gray display area or the second gray display area can be surrounded by the other display area, and the display area surrounded by the other display area can be formed in a specific shape.

As described above, the brightness of the first gray display area and the second gray display area can be periodically exchanged, while changing the brightness of the first and second gray display areas from light to dark and either maintaining or decreasing the difference between the two brightnesses, or while changing the brightnesses of the two display areas from dark to light and either maintaining or increasing the difference between the two brightnesses.

The brightness of the second gray display area can be periodically displayed with the same brightness as the first gray display area, similar to the method described above of periodically displaying solid black in the gray display area.

When applying the invention described above to the monitor of a computer system, a storage medium can be used for storing these monitor calibration methods in the form of an application program capable of being executed on a computer system.

Next, monitor calibration equipment necessary to achieve the monitor calibration methods described above will be described. Monitor calibration equipment of the present invention displays a solid black display area and a gray display area adjacently on a monitor display and aids the viewer in detecting the black point of the monitor display by gradually changing the brightness of the gray display area from dark to light or from light to dark. This monitor calibration equipment includes display area setting means for setting at least one portion of both the solid black display area and the gray display area so as to be interposed in the other display area on the monitor display; solid black display area control means for outputting display output of the minimum brightness to be displayed in the solid black display area set by the display area setting means; and gray display area control means for outputting display output which brightness is gradually varied from light to dark or from dark to light to be displayed in the gray display area set by the display area setting means.

The solid black display area and the gray display area set according to the display area setting means are stripe-shaped and arranged alternately. The alternately arranged stripes of the solid black display area and the gray display area have a width of between 1/72 and 1/4 inch, and particularly of between 1/36 and 1/8 inch.

The monitor calibration equipment of the present invention displays a solid black display area and a gray display area adjacently on a monitor display and aids the viewer in detecting the black point of the monitor display. by gradually changing the brightness of the gray display area from dark to light or from light to dark. This monitor calibration equipment includes a display area setting means for setting one of either the solid black display area or the gray display area so as to be surrounded by the other display area on the monitor display; solid black display area control means for outputting display output of the minimum brightness to be displayed in the solid black display area set by the display area setting means; and gray display area control means for outputting display output which brightness is varied from light to dark or from dark to light to be displayed in the gray display area set by the display area setting means.

One of either the solid black display area or the gray display area can be formed in a specific shape. In order to find a more precise black point, it is desirable for the specific shape to contain portions having a width of between 1/72 and 1/4 inch, and particularly of between 1/36 and 1/8 inch. Further, it is desirable to have many portions with the widths given above in order to find a more precise black point.

The monitor calibration equipment described above periodically exchanges the brightness of the solid black display area and of the gray display area, while changing the brightness of the gray display area from light to dark or from dark to light according to the solid black display area control means, which periodically displays in the solid black display area display output equivalent to the display output for the gray display area control means while at the same time the gray display area control means displays in the gray display area display output having the minimum brightness.

The gray display area control means can periodically output display output of the minimum brightness to the gray display area in order to periodically switch the gray display area to solid black.

The monitor calibration equipment aids the viewer in determining the black point of a monitor display. This monitor calibration equipment includes a display area setting means for adjacently setting a first gray display area and a second gray display area on the monitor display; first gray display area control means for outputting display output to the first gray display area set by the display area setting means; second gray display area control means for outputting display output to the second gray display area set by the display area setting means which output is different from the display output of the first gray display area control means; and display output control means for controlling display output of the first gray display area control means and display output of the second gray display area control means so that the display output for both is changed from light to dark while the difference in the display outputs is maintained or gradually decreased, or so that the display output for both is changed from dark to light while the difference in the display outputs is maintained or gradually increased.

The display area setting means can interpose at least one portion of the first gray display area and at least one portion of the second gray display area in the other display area on the monitor display, and can set the first gray display area and the second gray display area in alternately arranged stripe shapes. It is desirable if the alternately arranged stripes of the first gray display area and the second gray display area have a width of between 1/72 and 1/4 inch, and particularly of between 1/36 and 1/8 inch.

The display area setting means can set either the first gray display area or the second gray display area so as to be surrounded by the other display area on the monitor display. In this case, one display area can be formed in a specific shape.

The display output control means can be configured to periodically exchange display output of the first gray display area control means and display output of the second gray display area control means, while changing the display outputs from light to dark and either maintaining or decreasing the difference between the two display outputs, or while changing the display outputs from dark to light and either maintaining or increasing the difference between the two display outputs.

The second gray display area control means can be configured to periodically display in the second gray display area a display having the same brightness as the first gray display area.

In the present invention, the viewer of the monitor can also be an instrument used for measuring brightness and is not limited to a human viewer.

In the first embodiment of the present invention to be described later on, S100 is equivalent to the process of the display area setting means; S110 and S120 are equivalent to the process of the solid black display area control means; and S110 and S130 are equivalent to the process of the gray display area control means.

In the second embodiment, S100 is equivalent to the process of the display area setting means; S110 and S120 are equivalent to the process of the solid black display area control means; and S110, S130, S152, S154, S156, S170, S192, and S194 are equivalent to the process of the gray display area control means.

In the third embodiment, S100 is equivalent to the process of the display area setting means; S110, S120, and S196 are equivalent to the process of the solid black display area control means; and S110, S130, S170, and S196 are equivalent to the process of the gray display area control means.

In the fourth embodiment, S100 is equivalent to the process of the display area setting means; S120 is equivalent to the process of the first gray display area control means; S130 is equivalent to the process of the second gray display area control means; and S112 and S170 are equivalent to the process of the display output control means.

BRIEF DESCRIPTION OF THE DRAWINGS

The above and other objects, features and advantages of the present invention will become more apparent from the following description when taken in conjunction with the accompanying drawings, in which.

DETAILED DESCRIPTION OF THE PREFERRED EMBODIMENTS

In the following description, the expressions "front", "up" and "down" are used to define the various parts when a personal computer, printer and other equipments are disposed in an orientation in which they are intended to be used.

Figure 3:
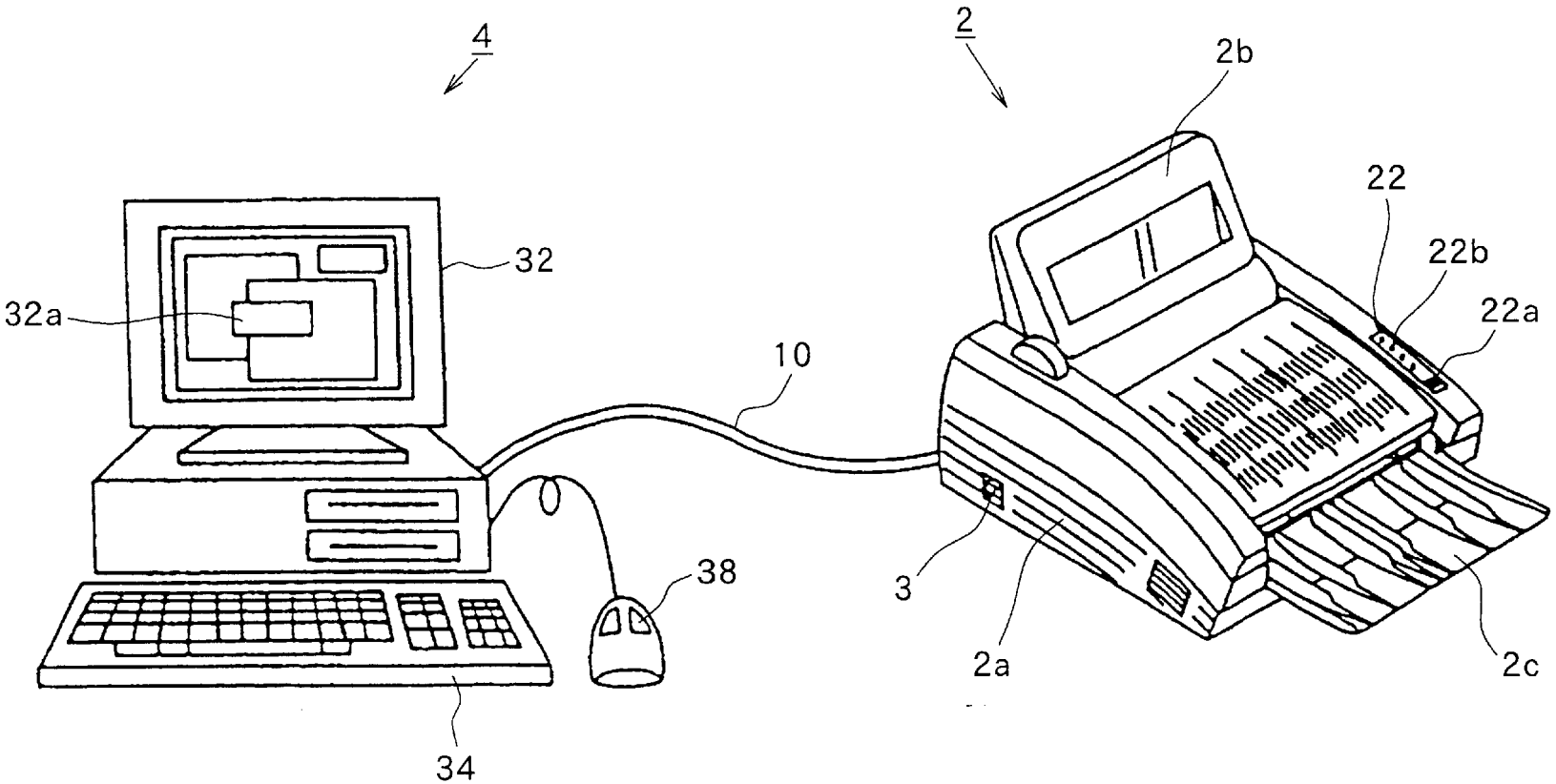
FIG. 3 is an explanatory diagram for the first embodiment of the present invention, showing the state in which a personal computer and printer are connected to each other.
Figure 4:
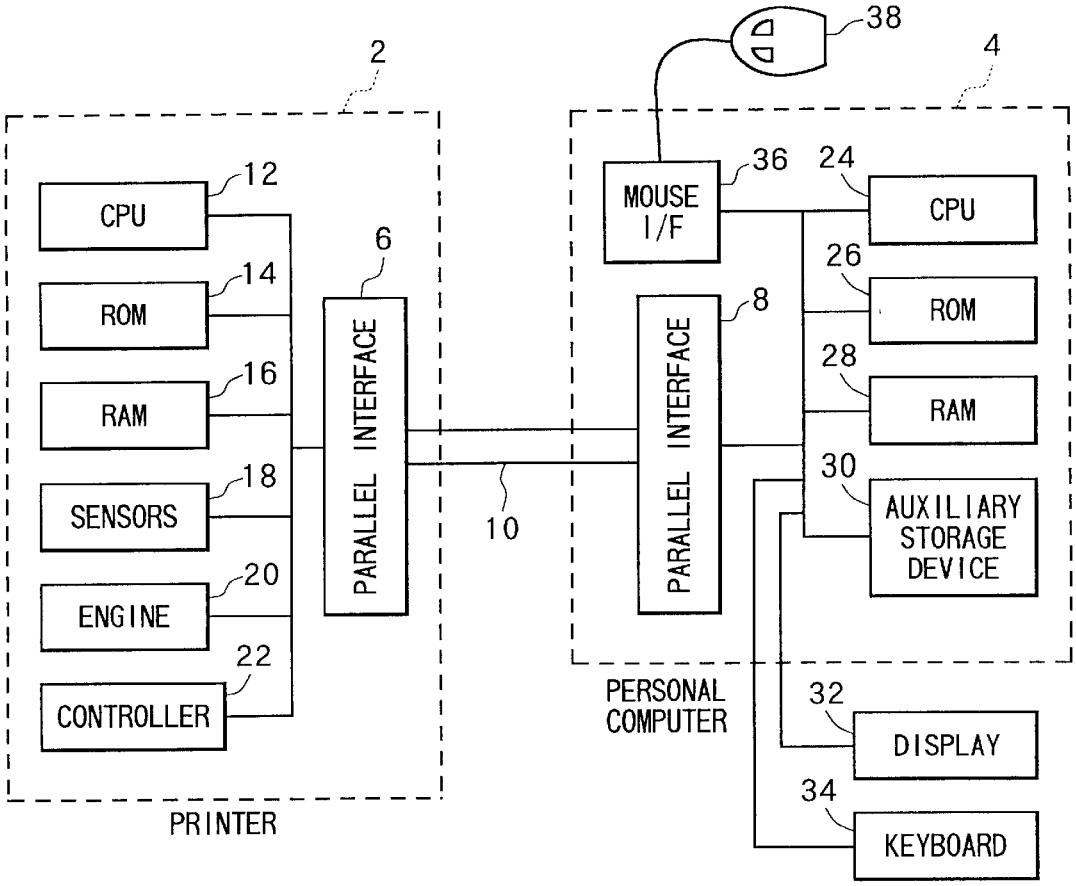
FIG. 4 is a block diagram showing the relevant components of the computer and printer of FIG. 3.

As shown in FIG. 3, the equipment configuration for the first embodiment includes a personal computer 4 connected to an ink jet printer 2. FIG. 4 is a block diagram showing the relevant parts of the above two components. The printer 2 and personal computer 4 employ parallel interfaces 6 and 8, respectively, based on the IEEE 1284 standard. An IEEE 1284-type cable 10 is used to connect the parallel interfaces 6 and 8.

In addition to the parallel interface 6, as shown in FIG. 4, the printer 2 includes a CPU 12 for executing various processes according to control programs; a ROM 14 for storing various control programs; a RAM 16 for storing results of calculations and various settings and containing work areas used by the CPU 12 when it performs calculations; a group of sensors 18 that include a paper feed sensor, a paper output sensor, and an ink level sensor; engines 20 such as a main motor for driving the mechanical parts of the printer 2; and a controller 22. The controller 22 includes a push-button switch 22*a* for issuing simple instructions to the printer 2 and LED lamps 22*b* for displaying instructions and statuses in order to set desired conditions.

As shown in FIG. 3, the printer 2 also includes a main body 2*a,* a paper feed unit 2*b* provided on the top back of the main body 2*a,* and a paper discharge tray 2*c* provided on the front of the main body 2*a*. A power switch 3 is provided on the side surface of the main body 2*a*. During printing operations, one sheet of paper at a time is supplied from inside the paper feed unit 2*b* into the printing unit of the printer 2. In the printing unit, images are formed on the paper by ink injections from recording heads, after which the paper is output onto the paper discharge tray 2*c*.

Referring again to FIG. 4, the personal computer 4 includes a CPU 24 for executing various processes according to control programs; a ROM 26 for storing various control programs; a RAM 28 for storing such programs as an operating system (OS), application programs, or device drivers, data for those programs, results of calculations by the CPU 24, and various settings; an auxiliary storage device 30 employing such storage media as floppy disks, magneto-optical disks, or CD-ROM discs for externally introducing programs, such as the OS, and data into the personal computer 4; a monitor display 32 for displaying results of calculations, menus, and the status of the printer 2 during printing operations; a keyboard 34 and a mouse interface 36 for receiving input from the user; and a mouse input device 38 for controlling movement of the mouse cursor displayed on the display 32 and inputting instructions via the mouse interface 36.

The personal computer 4 reads a printer driver program into the RAM 28 from the auxiliary storage device 30 and starts the program. Using this printer driver to communicate with the printer 2, the personal computer 4 exchanges handshake signals, including strobe signals and acknowledge signals, with the printer 2 via the control lines of the IEEE 1284 cable 10. The personal computer 4 can then transfer data and commands to the printer 2 via the data lines of the cable 10, to which commands the printer 2 responds by executing printing processes. If able to execute in byte mode, the printer 2 will transmit status data to the personal computer 4. If status data is received from the printer 2 during printing operations, the personal computer 4 will display the status of the printer 2 in a status monitor display area 32a on the display 32.

The printer driver provides functions for outputting a monitor calibration display to the display 32 in response to instructions from the user of the personal computer 4. The monitor calibration process is used to determine a black point, based on which value data output to the printer 2 is corrected so that the image formed on paper in the printer 2 will have color tones close to those in the image displayed on the display 32.

Figure 5:
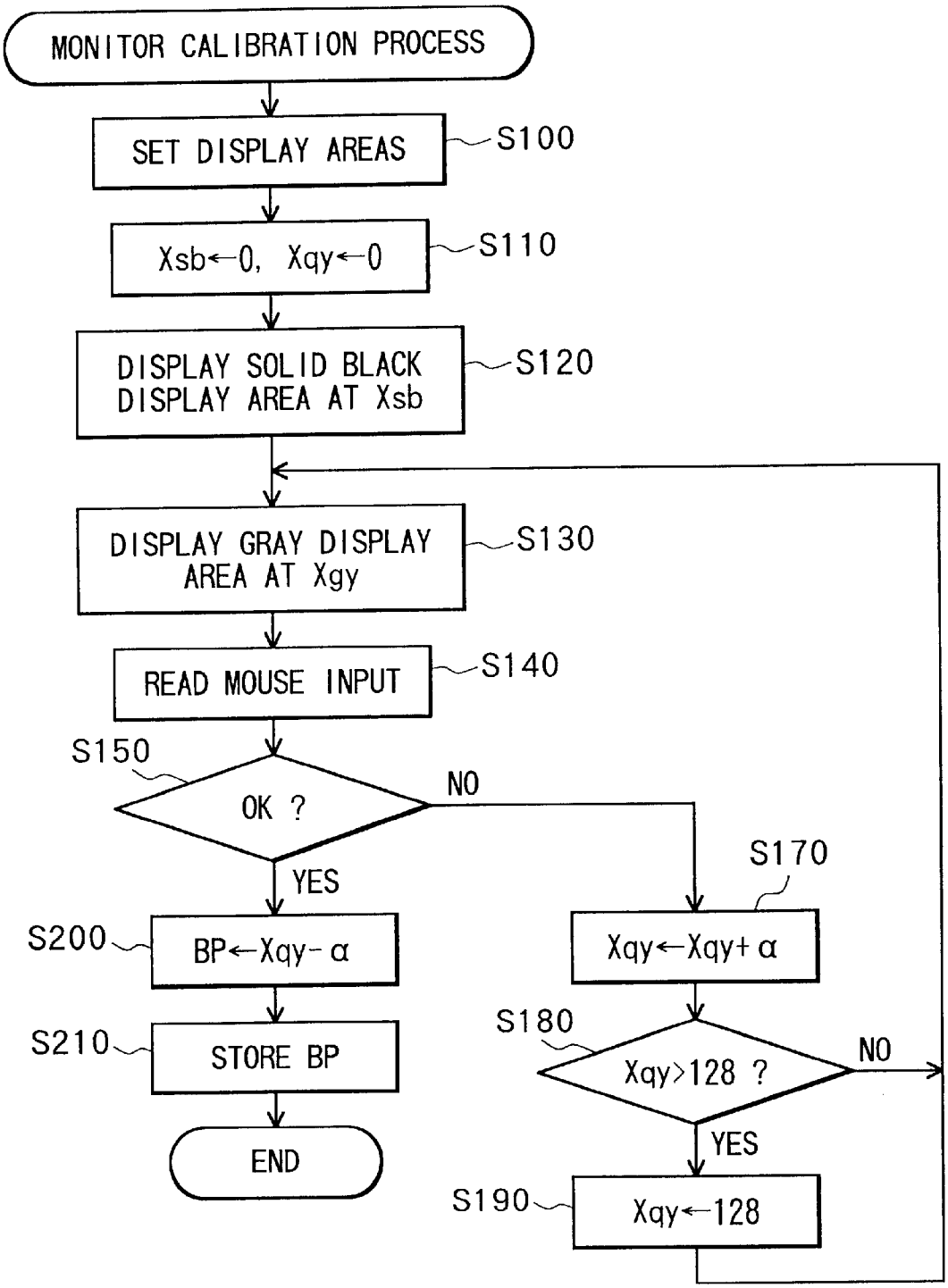
FIG. 5 is a flowchart showing the monitor calibration process for the first embodiment.

A first embodiment of the present invention will be described while referring to FIG. 5. FIG. 5 contains a flowchart showing this monitor calibration process according to the first embodiment. This monitor calibration process is a program included as part of the printer driver, which is stored on a floppy disk, magneto-optical disk, CD-ROM disc, or similar media that is mounted in the auxiliary storage device 30. When the printer driver is loaded into the RAM 28 and executed, the user can choose to execute the monitor calibration process as one of the printer driver functions.

Figure 6:
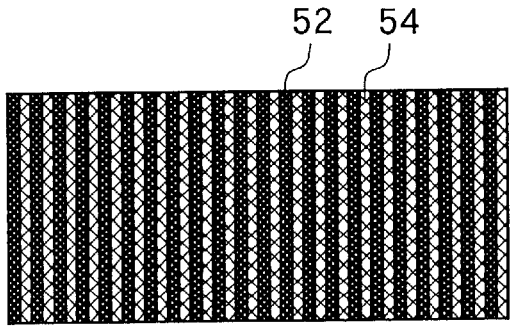
FIGS. 6(*a*) through 6(*c*) are explanatory diagrams showing the display area configurations used in the first embodiment.
Figure 6:
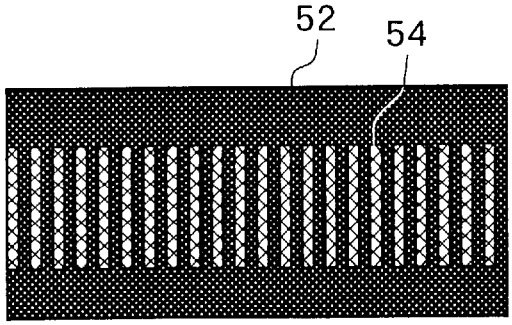
Figure 6:
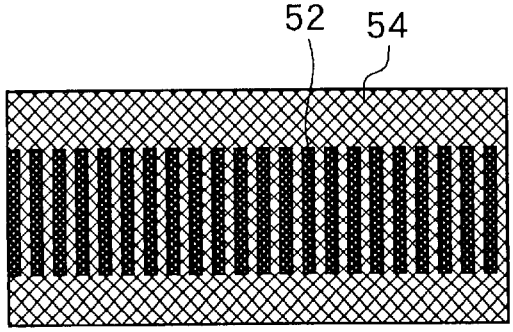

At the beginning of the monitor calibration process, the display areas for the screen on the display 32 are set (S100). The display areas include a solid black display area 52 and a gray display area 54 in the shape of vertical stripes positioned alternately side by side, as shown in FIG. 6(*a*). The width of the stripes in the two types of display areas 52 and 54 are the same and are set between 1/36 and 1/8 inch.

Figure 1:
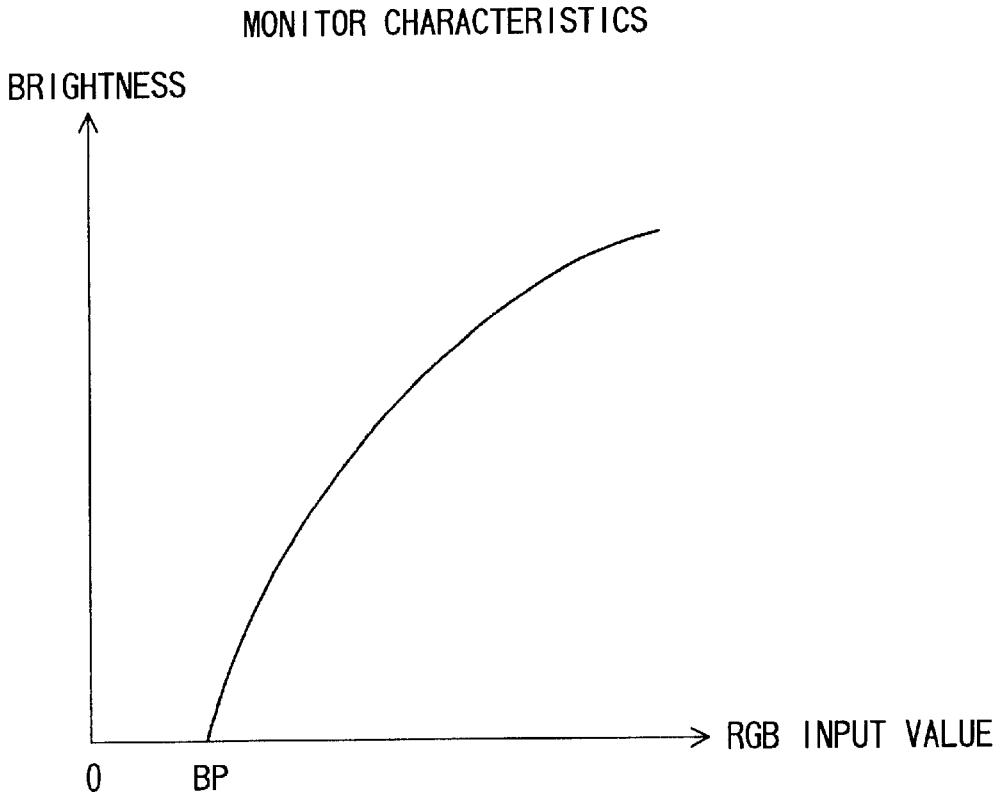
FIG. 1 PRIOR ART
FIG. 1 is an explanatory diagram showing monitor characteristics.
Figure 2:
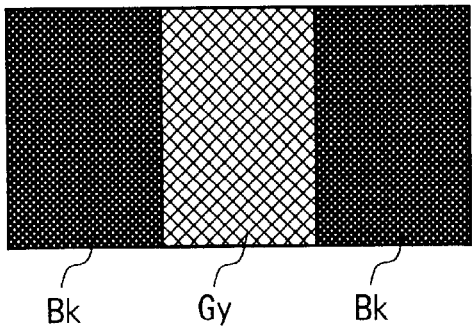
FIG. 2 PRIOR ART
FIG. 2 is an explanatory diagram showing a conventional display area configuration.

Variables Xsb and Xgy representing the input values of the solid black display area 52 and the gray display area 54, respectively, are initialized to 0 (S110). The input values for R, G, and B of each pixel in the solid black display area 52 are set equal to the input value Xsb and displayed on the display 32 (S120). Similarly, the input values for R, G, and B of each pixel in the gray display area 54 are set to the input value Xgy and displayed on the display 32 (S130). At this time, both the solid black display area 52 and the gray display area 54 have an input value of 0, represented by the point of origin in the graph of FIG. 1. That is, both display areas are solid black. According to the first embodiment, the range of possible input values is from 0 to 255.

Next, the control status of the mouse input device 38 is read (S140), and it is determined whether a mouse button was clicked to signify an "OK" message from the user (S150). If it is determined that the user did not click a mouse button to signify "OK" ("no" in S150), then Xgy is increased by a predetermined amount $\alpha$ (S170). Here, a is a positive number, but $\alpha$ is set to a negative number if decreasing Xgy (>0) toward 0, which process is described below in more detail.

Next, it is determined whether Xgy is greater than 128 (S180). If Xgy is not greater than 128 ("no" in S180), then the process returns to S130 and once again the gray display area 54 are displayed on the display 32 at the input value Xgy. This time the input value Xgy has been increased by the amount a since the last time the gray display area 54 were displayed. However, if Xgy is greater than 128 ("yes" in S180), then Xgy is set to 128 (S190). By doing this, the input value for Xgy is prevented from exceeding a maximum value of 128. Further, the time period of the loop beginning at S130 is set to provide sufficient time for the viewer to determine a difference in brightness between the solid black display area 52 and the gray display area 54.

The user clicks a button on the mouse input device 38, read the mouse input in S140, when visually confirming a difference in brightness between the solid black display area 52 and the gray display area 54. Therefore, until a mouse click is executed signifying confirmation, the determination in S150 will continue to be "no," and the value of Xgy will gradually increase. When Xgy exceeds the black point indicated by BP in FIG. 1, the viewer can confirm a difference in brightness between the solid black display area 52 and the gray display area 54.

At this time, the user clicks a button on the mouse input device 38 ("yes" in S150), and the input value of the black point is set to Xgy—$\alpha$ (S200). This black point input value is stored in either the RAM 28 or a writable storage medium set in the auxiliary storage device 30 (S210), and the monitor calibration process ends.

In the first embodiment described above, the solid black display area 52 and the gray display area 54 are arranged alternately in vertical stripes. In other words, both the solid black display area 52 and the gray display area 54 have stripes sandwiched by stripes of the other display area. Here, the difference in brightness seen in the gray display area 54 sandwiched by the solid black display area 52 appears differently from the solid black display area 52 sandwiched by the gray display area 54. By looking at both appearances simultaneously, even a subtle difference in brightness between the two display areas is visually striking. Hence, a very accurate black point can be determined.

It is possible to find a much more precise black point particularly because the solid black display area 52 and the gray display area 54 are arranged alternately in stripes and, moreover, because the width of these stripes is between 1/72 and 1/4 inch. It is desirable that the width of these stripes be between 1/36 and 1/8 inch. In addition to the arrangement of the solid black display area 52 and the gray display area 54 shown in FIG. 6(*a*), arrangements such as those shown in FIGS. . . 6(*b*) and 6(*c*) are also possible. In FIG. 6(*b*), stripes for the gray display area 54 are short and are surrounded by the solid black display area 52. In FIG. 6(*c*), the opposite is true: strips for the solid black display area 52 are short and are surrounded by the gray display area 54. In the arrangements shown in FIGS. 6(*a*) and 6(*b*), a display area abuts another display area not only on the left and right, but up and down and diagonally. Hence, even a subtle difference between the two display areas is visually striking.

Figure 7:
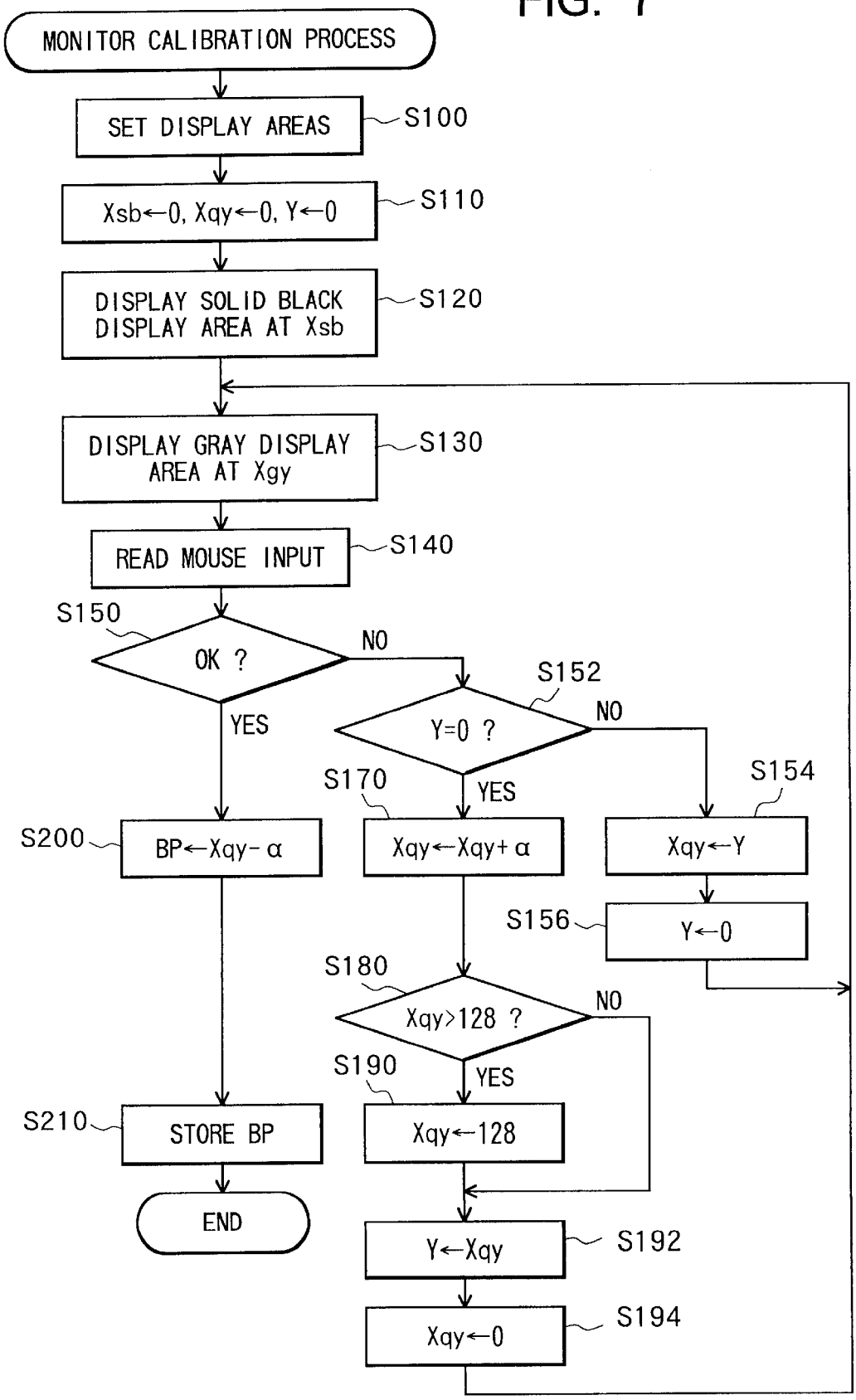
FIG. 7 is a flowchart showing the monitor calibration process of the second embodiment.

A second embodiment of the present invention will next be described while referring to FIG. 7. The second embodiment differs from the first embodiment only in the monitor calibration process. FIG. 7 is a flowchart showing the monitor calibration process of the second embodiment. In this process, steps S110, S152, S154, S156, S192, and S194 are different from the process of the first embodiment.

After S100 is processed, a variable Y is initialized to 0 in addition to the variables Xsb and Xgy (S110). Following the processes of S120 through S140, when the determination in S150 is "no" (the following description assumes the determinations in S150 are all "no"), it is determined whether Y is 0 (S152). Since Y was initialized to 0, the first time this step is processed Y is 0 ("yes" in S152), and steps S170 and S180 are processed (this description takes into account only cases in which Xgy is less than or equal to 128, and therefore, all determinations in S180 are "no"). Next, the variable Y is set to the value of Xgy (S192), and the value of Xgy is set to 0 (S194).

The process returns to S130. Since the value of Xgy is 0, the gray display area 54 are displayed at the input value 0 (S130). Following steps S140 and S150, Y now equals $\alpha$, which is greater than zero ("no" in S152). Next, Xgy is set to the value of Y (S154), and Y is set to 0 (S156). The process again returns to S130.

The gray display area 54 are displayed at the input value $\alpha$, since Xgy equals 60 (S130). Since Y equals 0 ("yes" in S152), the value of Xgy is increased by the amount $\alpha$ (S170). That is, Xgy now equals $2\alpha$. Therefore, Y is set to the value $2\alpha$ (S192), and Xgy is set to 0 (S194). The process again returns to S130.

Since Xgy equals 0, the gray display area 54 are displayed in solid black (S130). Y now equals $2\alpha$, which is greater than zero ("no" in S152). Therefore, Xgy is set to the value $2\alpha$ (S154), and Y is set to 0 (S156). The process again returns to S130.

The gray display area 54 are displayed at the input value $2\alpha$, since Xgy equals $2\alpha$ (S130). Since Y equals 0 ("yes" in S152), the value of Xgy is increased by the amount $\alpha$ (S170). That is, Xgy now equals $3\alpha$. Therefore, Y is set to the value $3\alpha$ (S192), and Xgy is set to 0 (S194). The process again returns to S130.

Since Xgy equals 0, the gray display area 54 are displayed in solid black (S130). Until the user signals "OK" by clicking the mouse button, or until the value of Xgy exceeds 128, the input value for displaying the gray display area 54 in S130 will follow the pattern $3\alpha \rightarrow 0$ (solid black) $\rightarrow 4\alpha \rightarrow 0 \rightarrow 5\alpha \rightarrow 0 \rightarrow 6\alpha \rightarrow \ldots$, wherein the value for Xgy continues to increase by the predetermined amount $\alpha$, but is reset to solid black between each increase.

In the second embodiment, while the input value Xgy is being increased, the gray display area 54 is changed back and forth between solid black and gray. As a result, the borders between the solid black display area 52 and the gray display area 54 are always emphasized, and the difference in brightness between the two display areas is more easily seen. Hence, a very accurate black point can be determined.

Figure 8:
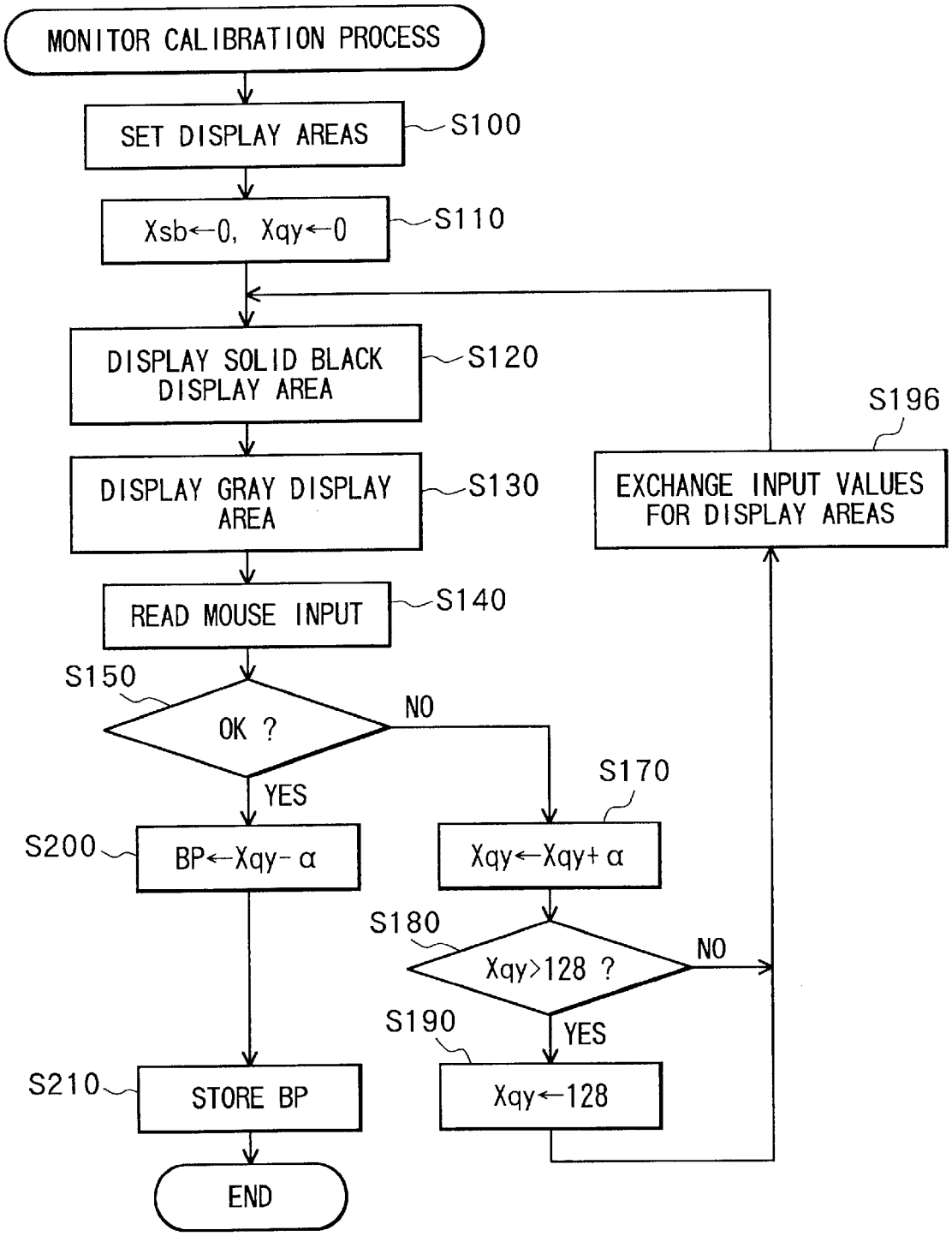
FIG. 8 is a flowchart showing the monitor calibration process of the third embodiment.

A third embodiment of the present invention will be described while referring to FIG. 8. The third embodiment differs from the first embodiment only in the monitor calibration process. FIG. 8 is a flowchart showing the monitor calibration process of the third embodiment. In this process, steps S100, S120, S130, and S196 are different from the process of the first embodiment. Further, the third embodiment differs therefrom in that the process returns to S120 after S196, rather than S130.

Figure 9:
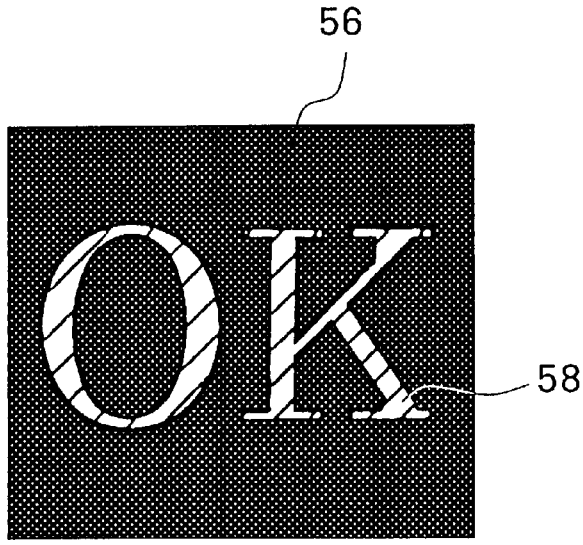
FIGS. 9(*a*) and 9(*b*) are explanatory diagrams showing the display area configurations used in the third embodiment.
Figure 9:
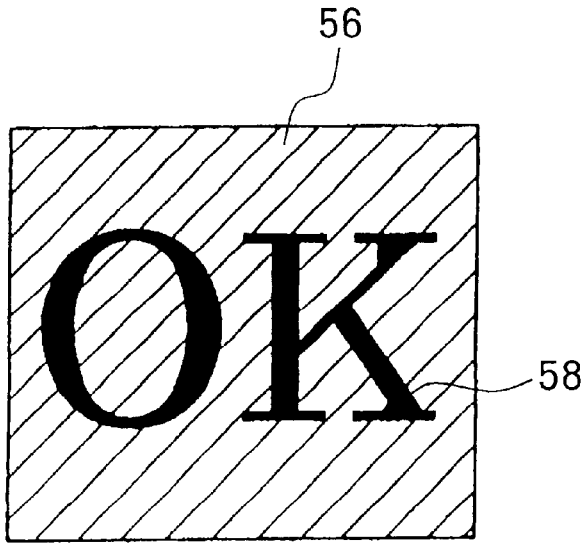

At the beginning of the process, the display areas for the screen on the display 32 are set as shown in FIG. 9(*a*) (S100). The display includes a gray display area 58 in the shape of a desired pattern, such as the characters "OK" shown in the diagram, surrounded by a solid black display area 56. Next, the variables Xsb and Xgy are initialized to 0 (S110). Then, the solid black display area 56 is displayed at the input value Xsb (S120), and the gray display area 58 is displayed at the input value Xgy (S130). Input from the mouse input device 38 is read (S140) and determined not to be an "OK" message from the user ("no" in S150).

Following S170 and S180, which are the same as described in the first embodiment, input values for the two display areas are exchanged (S196). That is, in the previous S120, the variable Xsb was the input value for the solid black display area 56 and the variable Xgy was the variable for the gray display area 58, but in S196, the variables previously used for the two display areas are exchanged. Accordingly, in the following steps, the solid black display area 56 is displayed using the input value Xgy (S120), and the gray display area 58 is displayed using the input value Xsb (S130).

If the previous state of the display on the display 32 is similar to that shown in FIG. 9(*a*), the next display will change to a state like that shown in FIG. 9(*b*). Further, since the input value Xgy gradually increases due to the process in S170, the display area displaying at Xgy gradually increases in brightness. However, usually the input value is increasing to values less than the black point, and therefore increases in the brightness may not necessarily be visible to the naked eye.

Once again the variables used for the solid black display area 56 and the gray display area 58 are exchanged (S196). Accordingly, in the following steps, the solid black display area 56 is displayed using the input value Xsb (S120), and the gray display area 58 is displayed using the input value Xgy (S130). As a result, the display state returns to that shown in FIG. 9(*a*), except that the input value Xgy has increased by the amount a. Hereafter, the variables used for the solid black display area 56 and gray display area 58 are exchanged every time S196 is executed.

In the third embodiment, therefore, by periodically exchanging the brightness relationship between the solid black display area 56 and gray display area 58 in order to change the brightness of the gray display area 58 between dark and light, the borders between the solid black display area 56 and the gray display area 58 are always emphasized, and the difference in brightness between the two display areas is more easily seen. Hence, a very accurate black point can be determined.

Most portions of the characters "OK" making up the gray display area 58 have a width of between 1/72 and 1/4 inch, and a portion of the characters have a width between 1/36 and 1/8 inch. The part of the solid black display area 56 that is surrounded by the characters "OK" includes portions having widths between 1/72 and 1/4 inch and between 1/36 and 1/8 inch. With this arrangement, it is possible to find an even more precise black point.

Figure 10:
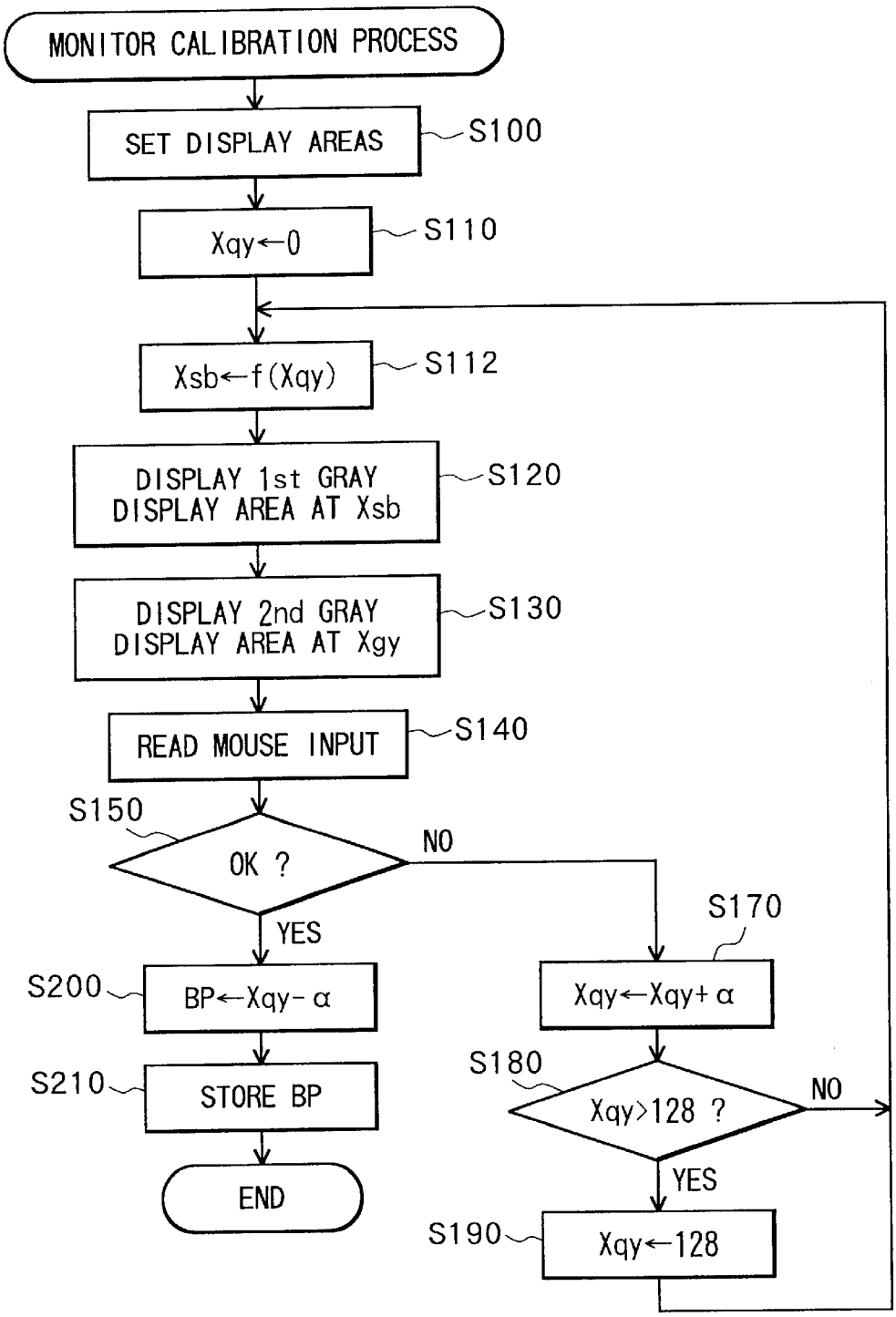
FIG. 10 is a flowchart showing the monitor calibration process of the fourth embodiment.
Figure 11:
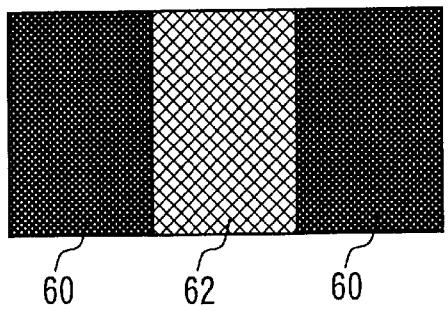
FIG. 11 is an explanatory diagram showing the display area configuration used in the fourth embodiment.

A fourth embodiment of the present invention will finally be described while referring to FIGS. 10 and 11. The fourth embodiment differs from the first embodiment only in the monitor calibration process. FIG. 10 is a flowchart showing the monitor calibration process of the fourth embodiment. In this process, steps S100, S110, and S112 are different from the process of the first embodiment. Further, the fourth embodiment differs therefrom in that the process returns to S112 after S180 and S190. Although the names of the display areas used in S120 and S130 have changed, they are essentially the same as those in S120 and S130 of the first embodiment.

At the beginning of the process, a first gray display area 60 and second gray display area 62 are set as shown in FIG. 11 (S100). Next, the variable Xgy is initialized to 0 (S110). Using the value of Xgy, Xsb is found with the following Formula 1 (S112).

$$Xsb \leftarrow f(Xgy) \quad \text{[Formula 1]}$$

Here, f (x) represents a prescribed process such as one of the following example processes in Formulae 2 and 3.

$$f(x)=x/2 \quad \text{[Formula 2]}$$

and $$f(x)=x-10 \ \{x: x \geqq 10\} \quad \text{[Formula 3]}$$

$$f(x)=0 \ \{x: x<10\}$$

Next, the first gray display area 60 is displayed at the input value Xsb found in S112 (S120), and the second gray display area 62 is displayed at the input value Xgy (S130). Assuming no input from the mouse input device 38 in S140 is detected ("no" in S150), Xgy is increased by the amount a (S170). After determining that Xgy is not greater than 128 ("no" in S180), the process returns to S112.

Since Xgy was increased by the amount α in S170, Xsb is now calculated using the new value of Xgy in Formula 1 (S112). Hereafter, while no mouse input indicating "OK" is detected (S150) and while Xgy is not greater than 128 (S180), Xgy is gradually increased by the amount α, and, if using Formula 2, for example, Xsb is increased by α/2.

The first gray display area 60 and second gray display area 62 have different brightnesses and are adjacently displayed on the display 32. The input values for the display areas are increased in order either to maintain the difference in brightness between the two display areas, as when using Formula 3, or to increase the difference in brightness between the two display areas, as when using Formula 2, aiding the viewer in detecting the black point.

As described above, the fourth embodiment uses two gray display areas 60 and 62, having different brightnesses rather than a solid black display area. In order to aid in determining the black point, the difference in brightness between the two gray display areas 60 and 62 is either maintained or gradually increased, while the brightnesses are changed from dark to light. For this reason, or perhaps due to the brightness of the entire display changing dynamically, it is possible to acquire an appropriate and more precise black point input value for use in actual image displays.

Although the present invention has been described with respect to specific embodiments, it will be appreciated by one skilled in the art that a variety of changes may be made without departing from the scope of the invention. For example, certain features may be used independently of others and equivalents may be substituted all within the spirit and scope of the invention.

In the above description of the first embodiment, the solid black display area 52 and the gray display area 54 are formed in the shape of vertical stripes. However, the stripes can also be horizontal.

In the above descriptions of the embodiments, the input value is increased in the monitor calibration process. However, it is also possible to perform the process by decreasing the input value. In this case, the black point is set to Xgy in S200 rather than Xgy−α. In fact, if the value of α is sufficiently small, there is essentially no problem in setting the black point to Xgy in S200 when performing the process with increasing input values, as well.

In the above descriptions of the third and fourth embodiments, monitor calibration was performed using the display areas shown in FIGS. 9 and 11, respectively. However, in place of these display areas, the display areas in FIG. 12(*a*) could also be used. Here, the star shape is formed by a second gray display area 66 (gray display area), while the area surrounding the star shape is a first gray display area 64 (solid black display area). The opposite configuration, in which the star shape is formed by the first gray display area 64 and the area surrounding the star shape is formed by the second gray display area 66, can also be used.

Figure 12:
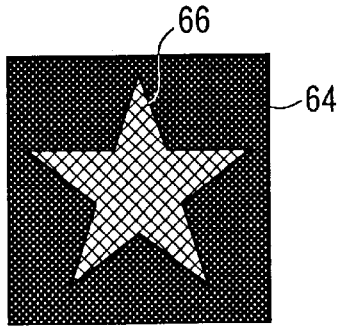
FIGS. 12(*a*) and 12(*b*) are explanatory diagrams showing other display area configurations.
Figure 12:
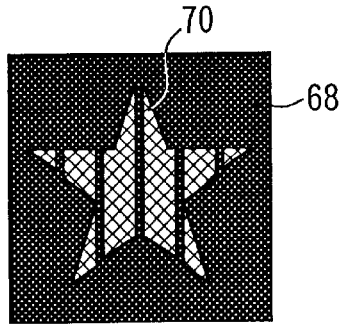

In the above descriptions of the first and second embodiments, stripe-shaped areas shown in FIGS. 6(*a*) through 6(*c*) are used. However, it would also be possible to use a special shape, such as a star shape, and divide the shape into stripes, as shown in FIG. 12(*b*). Here, the star shape is formed by a gray display area 70, while the area surrounding the star shape is formed by a solid black display area 68. The opposite configuration, in which the star shape is formed by the solid black display area 68 and the area surrounding the star shape is formed by the gray display area 70, can also be used.

Figure 13:
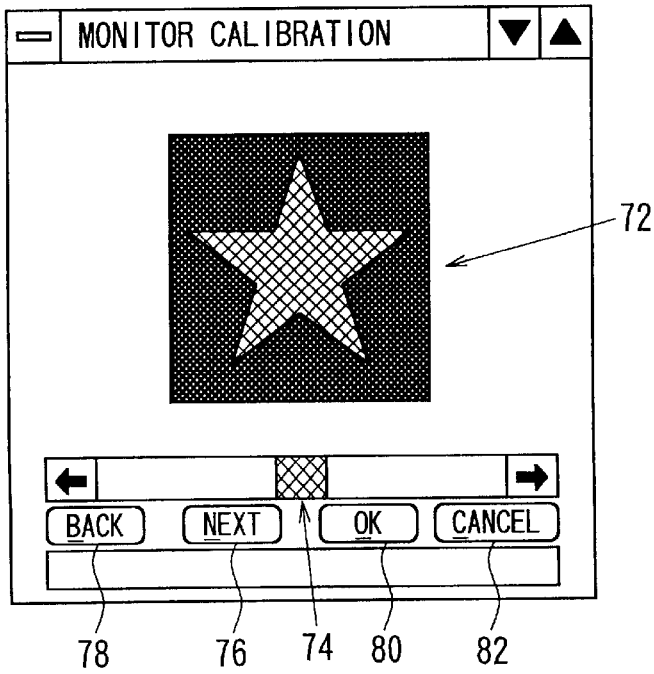
FIG. 13 is an explanatory diagram showing another display area configuration.

In the above descriptions of all the embodiments, the amount α specifying the amount that the input value is increased per step can be set by placing the mouse cursor over a slider 74 displayed along with a display area 72, as shown in FIG. 13, and dragging the slider left or right to the position representing a desired value.

As shown in FIG. 13, the display screen is provided with a "Next" button 76 and a "Back" button 78. The monitor calibration process can be controlled by lining up the mouse cursor on one of these buttons and clicking the mouse button. For example, in the monitor calibration process of FIG. 5, after determining that no mouse input indicating "OK" has been received in S150, if it is determined that the "Next" button 76 has been pushed according to input from the mouse input device 38, S170 is executed with a positive a value. If it is determined that the "Back" button 78 has been pushed, S170 is executed with a negative a value. Hence, it is possible to increase or decrease the input value for the gray display area 54 using only operations of the mouse input device 38. With this configuration, it is necessary to include a step ensuring that Xgy does not become a negative number.

Further, an "OK" button 80 and a "Cancel" button 82 are provided in the display screen of FIG. 13. If the "OK" button is clicked by the mouse input device 38, a "yes" determination is made in S150 of the monitor calibration process in FIG. 5. The "Cancel" button 82 is provided for immediately quitting the monitor calibration process.

What is claimed is:

1. A method of detecting a black point of a monitor capable of being executed on a computer for calibration of a gradation component input to a monitor driver, comprising the steps of:

displaying a solid black display area and a gray display area adjacent to one another; and gradually changing brightness of the gray display area from light to dark or from dark to light, wherein at least one portion of the solid black display area is interposed in the gray display area and at least one portion of the gray display area is interposed in the solid black display area to detect a black point of a monitor and the brightness of the solid black display area and the gray display area are periodically exchanged while simultaneously and gradually changing the brightness of the gray display area from light to dark or from dark to light.

2. The method as claimed in claim 1, wherein the solid black display area and the gray display area are strip-shaped and arranged alternately.

3. The method as claimed in claim 2, wherein the alternately arranged stripes of the solid black display area and the gray display area have a width of between 1/72 and 1/4 inch.

4. The method as claimed in claim 2, wherein the alternately arranged stripes of the solid black display area and the gray display area have a width of between 1/36 and 1/8 inch.

5. A storage medium for storing an application program for carrying out the method as claimed in claim 1 and capable of being executed on a computer.

6. A method of detecting the black point of a monitor comprising the steps of:

calibrating on a computer a gradation component input to a monitor driver by displaying a solid black display area and a gray display area adjacent to one another; and gradually changing brightness of the gray display area from light to dark or from dark to light, wherein a selected one of the solid black display area and the gray display area is surrounded by a non-selected one of the solid black display area and the gray display area to detect a black point of a monitor and the brightness of the solid black display area and the gray display area are periodically exchanged, while the brightness of the gray display area is gradually changed from light to dark or from dark to light.

7. The method as claimed in claim 6, wherein the solid black display area and the gray display area form a specific shape.

8. The method as claimed in claim 7, wherein the solid black display area and gray display area that form a specific shape each contain portions having a width of between 1/72 and 1/4 inch.

9. The method as claimed in claim 7, wherein the solid black display area and gray display area that form a specific shape each contain portions having a width of between 1/36 and 1/8 inch.

10. A monitor calibration equipment for detecting a black point of a monitor display capable of being executed on a computer for calibration of a gradation component input to a monitor driver, comprising:

display area setting means for setting at least one portion of both a solid back display area and a gray display area on the monitor display so as to be interposed in the other display area;

solid black display area control means for outputting display output of a minimum brightness to be displayed in the solid black display area set by the display area setting means; and gray display area control means for outputting display output which brightness is gradually varied from light to dark or from dark to light to be displayed in the gray display area set by the display area setting means to detect a black point of a monitor, wherein the solid black display area control means periodically displays in the solid black display area output equivalent to the display output for the gray display area control means while at the same time the gray display area control means displays in the gray display area display output having the minimum brightness, in order that the brightness of the solid black display area and of the gray display area are periodically exchanged, while the brightness of the gray display area is gradually changed from light to dark or from dark to light.

11. The monitor calibration equipment as claimed in claim 10, wherein the solid black display area and the gray display area set by the display area setting means are stripe-shaped and arranged alternately.

12. The monitor calibration equipment as claimed in claim 11, wherein the alternately arranged stripes of the solid black display area and the gray display area have a width of between 1/72 and 1/4 inch.

13. The monitor calibration equipment as claimed in claim 11, wherein the alternately arranged stripes of the solid black display area and the gray display area have a width of between 1/36 and 1/8 inch.

* * * * *